US006311489B1

(12) United States Patent
Stangl et al.

(10) Patent No.: US 6,311,489 B1
(45) Date of Patent: Nov. 6, 2001

(54) REGULATING DEVICE FOR AN ADJUSTABLE HYDRAULIC PUMP WITH SEVERAL CONSUMERS

(75) Inventors: Helmut Stangl; Detlef van Bracht; Mikko Erkkilae, all of Horb (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 0 days.

(21) Appl. No.: 09/509,243

(22) PCT Filed: Sep. 24, 1998

(86) PCT No.: PCT/EP98/06083

§ 371 Date: Mar. 23, 2000

§ 102(e) Date: Mar. 23, 2000

(87) PCT Pub. No.: WO99/15792

PCT Pub. Date: Apr. 1, 1999

(30) Foreign Application Priority Data

Sep. 24, 1997 (DE) ..... 197 42 157

(51) Int. Cl.[7] ..... F16D 31/02
(52) U.S. Cl. ..... 60/452
(58) Field of Search ..... 60/452; 417/213

(56) References Cited

U.S. PATENT DOCUMENTS 4,668,171 * 5/1987 Beutler et al. ..... 417/213
5,201,803 4/1993 Goto et al. .
5,993,168 * 11/1999 Erkkilae et al. ..... 60/452

FOREIGN PATENT DOCUMENTS 34 10 071 A1 10/1985 (DE) .
36 28 370 A1 2/1988 (DE) .
195 17 974 A1 11/1996 (DE) .
05-099126 4/1993 (JP) .

* cited by examiner

*Primary Examiner*—F. Daniel Lopez
(74) *Attorney, Agent, or Firm*—Scully, Scott, Murphy & Presser

(57) ABSTRACT

A control device for an adjustable hydraulic pump (1), wherein the hydraulic pump is connected to a plurality of users, by delivery lines (5*a–d*). A first control line (18*a–d*), is connected to each of the delivery lines downstream of a respective proportioning throttle (6*a–d*). A first pressure change device (17) selects a highest pressure prevailing in the first control lines and supplies it to a delivery flow control valve (15), which controls an adjusting pressure for an adjusting device (7) for the hydraulic pump, based on a pressure difference between the highest pressure from the first pressure change device and a pressure from a second control line (19) connected to the output of the pump. A power control valve (27) is connected between the first control lines of a power-controlled group of users and a pressure medium tank (19), with pressure from the first control lines acting to open the power control valve, and the adjusting device acting, via a measuring spring arrangement (29), to close the power control valve. The first control lines of a non-power-controlled group of users are separated from the power control valve.

9 Claims, 2 Drawing Sheets

REGULATING DEVICE FOR AN ADJUSTABLE HYDRAULIC PUMP WITH SEVERAL CONSUMERS

The invention relates to a control device for a hydraulic pump, particularly for controlling a construction machine such as an excavator/loader.

A control device is known from DE 195 17 974 A1. A similar control device emerges from DE 33 45 264 A1. In the known control devices an adjustable hydraulic pump delivers into a delivery line which leads to a user. An adjustable delivery flow throttle and/or proportioning throttle with which the delivery flow for the user is pre-set is provided in the delivery line. To control the delivery flow delivered by the hydraulic pump, a delivery flow control valve is provided which is connected to the delivery line downstream of the proportioning throttle via a first control line and to the delivery line upstream of the proportioning throttle via a second control line. The pressure drop occurring at the proportioning throttle thus serves to control the delivery flow control valve which controls the adjusting pressure for an adjusting device acting on the delivery volume of the hydraulic pump. A power control valve is additionally provided, which is arranged between the first control line and a pressure medium tank. In the direction of opening the power control valve is acted upon by the control pressure in the first control line whereas in the closure direction it is acted upon by the adjusting device via a measuring spring arrangement as a function of the delivery volume of the hydraulic pump pre-set by the adjusting device. By means of a suitable selection of the measuring spring arrangement the hyperbolic characteristic of a pre-set maximum power may be at least approximately simulated. In a control range below the pre-set maximum power the control characteristic of the control device is determined by the delivery flow control valve which adjusts the delivery flow of the hydraulic pump to the value pre-set by the opening cross-section of the proportioning throttle. If the pre-set maximum power is exceeded, however, the power control valve responds and limits the pressure in the first control line so that the hydraulic pump is swivelled back and an overload is prevented.

In principle the known control devices are also suitable for controlling several users. In practice, however, the problem arises that power control is not required in all operating states. In construction machines in particular there are hydraulic users for which power control is required in order to prevent an overload of the drive motor for the hydraulic pump whereas there are other users for which a power restriction leads to an undesired shortage of power. In an excavator/loader for example, one or more items of hydraulic operating equipment and a hydraulic travel drive are driven. In the excavator operation of the excavator/loader in which the vehicle is at a fixed location, the drive power for the excavating shovels is unlimitedly available and a power restriction would lead to an undesired shortage of power. In a loader operation, however, in which the excavator/loader is continuously moved by a hydraulic travel drive, the available pump output must be distributed to the item or items of operating equipment and the travel drive. In this case a power restriction for the travel drive is required so as to prevent an overloading of the motor driving the hydraulic pump. Similar problems also arise in practice for other construction machines.

The object of the invention is therefore to provide a control device for an adjustable hydraulic pump with which the control of several users is possible in such a way that as optimum as possible a power distribution is achieved.

The invention is based on the finding that an optimum power distribution may be achieved in that only selected, power-controlled users are connected to the power control valve whereas the remaining users do not respond to the power control valve. In contrast the delivery flow control valve is connected to all users including the non-power-controlled users via a pressure change device. The highest control pressure in each case of the control pressures prevailing in the first control lines is selected and conveyed to the delivery flow control valve. According to the solution according to the invention, therefore, only those users which may actually lead to an overload of the drive motor driving the hydraulic pump have an influence on power control. For the remaining users, a shortage of power by means of an unnecessary power restriction is avoided.

In the simplest case, only a single power-controlled user may be provided, the first control line of which is connected to the power control valve via a connecting line. The connecting line opens into the first control line of this power-controlled user upstream of the first pressure change device for selecting the control pressure for the delivery flow control valve. The power-controlled user in a construction machine, e.g. an excavator/loader, may be the travel drive for example.

If a power control for several users is to be provided, the highest control pressure in each case in the first control lines of the group of power-controlled users may be selected by a second pressure change device and be conveyed to a connecting line leading to the power control valve.

A throttle to limit the flow through the power control valve may be provided in the connecting line leading to the power control valve. Alternatively or additionally this throttle may also be arranged in each first control line allocated to a power-controlled user.

The first and the second pressure change device may consist of one pressure change valve or several pressure change valves arranged behind each other in interconnected manner. Particularly advantageously the second pressure change device may be part of the first pressure change device. By means of a last pressure change valve the highest control pressure in each case of the power-controlled users is compared with the highest control pressure in each case of the non-power-controlled users and the control pressure which is the highest overall in each case is selected to control the delivery flow control valve. Additionally, a pressure control valve, which is controlled by the control pressure in the second control line, may be arranged between the delivery flow control valves of the adjusting device. The control pressure in the second control line corresponds to the pressure in the delivery line at the outlet of the hydraulic pump upstream of the proportioning throttles. When the outlet pressure of the hydraulic pump exceeds a pre-set limit, the pressure control valve responds and swivels the hydraulic pump back.

The control device according to the invention may be used to control a construction machine, particularly an excavator/loader in particularly advantageous manner. In this case at least the travel drive of the excavator/loader is a power-controlled user.

The invention will be described in greater detail below with reference to the drawings in which:

FIG. 1 shows a first embodiment of the control device according to the invention. An adjustable hydraulic pump 1 is driven by a drive unit, e.g. a diesel engine, via a drive shaft 2. The hydraulic pump 1 draws in the pressure medium via a tank line 3 from a pressure medium tank 4 and conveys the pressure medium into a delivery line 5. The delivery line 5 branches into two separate delivery lines 5*a* and 5*b*, which each lead to separate users. A proportioning throttle 6*a* and 6*b* is provided in each case in each of the delivery lines 5*a* and 5*b*. The proportioning throttles 6*a* and 6*b* are adjustable to set the delivery flow for the users. The proportioning throttles 6*a* and 6*b* may take the form of manual control transmitters for example and be arranged in the driver's cab of a construction machine.

Figure 1:
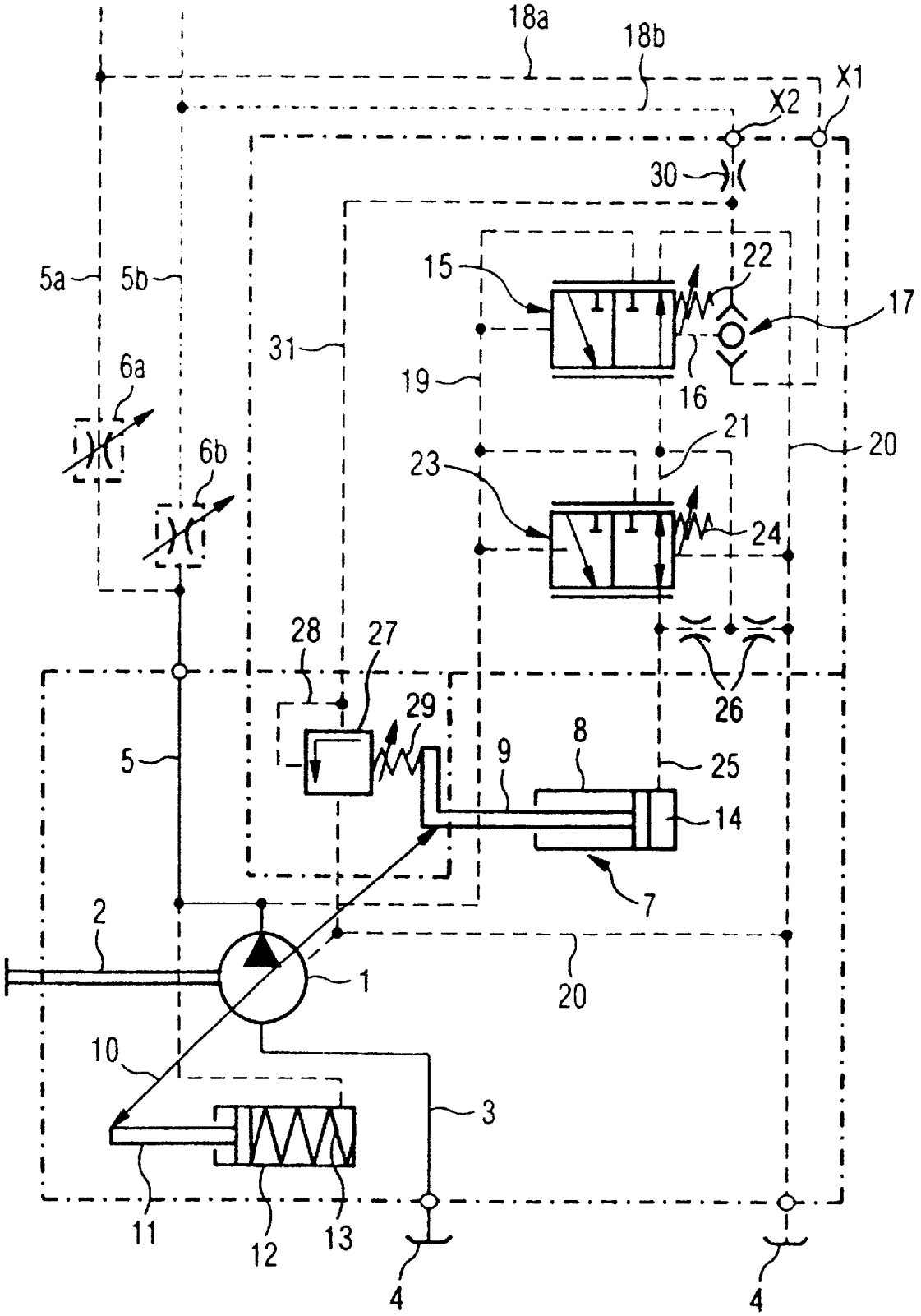
FIG. 1 shows a first embodiment of the control device according to the invention.

An adjusting device generally denoted by 7 serves to adjust the delivery volume of the hydraulic pump 1. In the embodiment shown in FIG. 1 the adjusting device 7 consists of a first adjusting cylinder 8, in which a first adjusting piston 9 which is connected to the adjusting unit 10 of the hydraulic motor is movably arranged. Also connected to the adjusting unit 10 of the hydraulic motor 1 is a second adjusting piston 11 which is movably arranged in a second adjusting cylinder 12 and is acted upon by means of a swivel-out spring 13 in such a way that the hydraulic pump 1 is swivelled out in the direction of maximum delivery volume by the swivel-out spring 13. The hydraulic pump 1 is swivelled back in the direction of minimal displacement volume by application of pressure to the cylinder chamber 14 in the first adjusting cylinder 8. The first adjusting cylinder 8 and the second adjusting cylinder 12 as well as the first adjusting piston 9 and the second adjusting piston 11 may also be structurally combined.

A delivery flow control valve 15 is provided to control the delivery flow. A first control inlet of the delivery flow control valve 15 is connected to a pressure change valve 17 via a connecting line 16. The pressure change valve 17 selects the highest control pressure in each case in two first control lines 18*a* and 18*b* which lead to the pressure control valve 17 in each case from an allocated delivery line 5*a* and/or 5*b* downstream of the proportioning valves 6*a* and/or 6*b* provided in the delivery lines 5*a* and 5*b* via a control inlet X1 and/or X2. The delivery flow control valve 15 is further connected via a second control line 19 to the delivery line 5 upstream of the proportioning throttles 6*a* and 6*b*. The delivery flow control valve 15 is thus controlled by the pressure difference at those proportioning throttles 6*a* and 5*b* which have the highest delivery pressure in each case downstream of the proportioning valve 6*a* and/or 6*b*. In the embodiment shown the delivery flow control valve 15 is designed as a 3/2-way valve. The two inlets of the delivery flow control valve 15 are connected on the one hand to the delivery line 5 via the first control line 19 and on the other hand to the pressure medium tank 4 via the tank line 20. Depending on the pressure difference between the two control inlets of the delivery flow control valve 15, an adjusting pressure which acts upon the cylinder chamber 14 of the first adjusting cylinder 8 is established in the connecting line 21. In the rest position of the delivery flow control valve 15 the valve body of the delivery flow control valve 15 is displaced by the restoring spring 22 in such a way that the connecting line 21 is aerated towards the pressure medium tank 4.

In the embodiment shown, a pressure control valve 23 which serves to limit pressure in the delivery line 5 is arranged between the delivery flow control valve 15 and the cylinder chamber 14 of the adjusting device 7. As soon as the delivery pressure in the delivery line 5 at the outlet of the hydraulic pump 1 exceeds a maximum pressure pre-settable by the restoring spring 24, the adjusting pressure line 25 leading to the adjusting device 7 is acted upon with an increased adjusting pressure in that the pressure control valve 23 designed as a 3/2-way valve in the embodiment is displaced into a control position in which the second control line 19 acted upon with the delivery pressure is directly connected to the adjusting pressure line 25. By this means the hydraulic pump 1 is swivelled back and an overpressure in the delivery line 5 avoided.

In the embodiment shown, there is a throttle chain 26 between the adjusting pressure line 25 and the tank line 20 in order to facilitate the return flow of the pressure medium from the cylinder chamber 14 to the pressure medium tank 4.

A power control valve 27 is additionally provided. The power control valve 27 is arranged between the first control line 18*b* connected to the delivery line 5*b* and the tank line 20 leading to the pressure medium tank 4. The power control valve 27 is acted upon on the one hand by the control pressure prevailing in the first control line 18*b* via the diverter line 28 in the opening direction. On the other hand the power control valve 27 is acted upon by the adjusting device 7 via a measuring spring arrangement 29 in the closure position. The measuring spring arrangement 29 is arranged between the adjusting piston 9 and a valve piston of the power control valve 27 not shown in greater detail. As pressure increases in the delivery line 5*b* downstream of the allocated proportioning throttle 6*b*, the power control valve 27 is acted upon in the opening direction. In contrast, the power control valve 27 is acted upon increasingly by the adjusting device 7 via the measuring spring arrangement 29 in the closure position if the delivery volume of the hydraulic pump 1 decreases. By a suitable measuring spring arrangement 29, particularly by the interconnecting of several springs with different spring constant, a hyperbolic control characteristic of virtually constant maximum power may be simulated.

The mode of operation of the control device according to the invention will be described in greater detail below.

A power-controlled user is connected to the delivery line 5*b* whereas a non-power-controlled second user is connected to the delivery line 5*a*. If only the proportioning throttle 6*a* is open, but the proportioning throttle 6*b* closed, the inlet X2 is pressureless whereas a control pressure is set at the control inlet X1 of the first control line 18*a*. The pressure change valve 17 thus connects the first control line 18 to the corresponding control inlet of the delivery flow control valve 15 so that the pressure drop in the proportioning throttle 6*a* is adjusted to a constant value by the delivery flow control valve 15. The control inlet X2 and hence the first control line 18*b*, however, are separated from the corresponding control inlet of the delivery flow control valve. The pressure drop at the proportioning throttle 6*b* thus has no influence on-the delivery flow control. As the control inlet X2 is pressureless, the power control valve 27 is also not acted upon with a control pressure via the diverter line 28 in the opening direction. In this operating state the power control is not, therefore, active. An item of operating equipment, e.g. in the form of a hydraulically operable excavator shovel, may be arranged at the delivery line 5*a*. During operation purely as an excavator, the power control is thus switched off and an undesired shortage of power does not occur.

If, in contrast, the proportioning throttle 6*a* is closed and the proportioning throttle 6*b* open, the control inlet X1 is pressureless and the control inlet X2 is acted upon with the delivery pressure in the delivery line 5*b* via the first control line 18*b*. The control pressure in the first control line 18*b* reaches the delivery flow control valve 15 via the pressure change valve 17 whereas the first control line 18*a* connected to the delivery line 5*a* is separated by the pressure change valve 17 from the delivery flow control valve 15. A delivery flow control takes place by means of the delivery flow control valve 15 below the maximum power pre-set by the power control valve 27. If the pre-set maximum power is exceeded, the power control valve 27 responds and connects the first control line 18*b* to the pressure medium tank 4 via the tank line 20. By means of the pressure drop in the first control line 18*b* the delivery flow control valve 15 is substantially acted upon by the pressure in the second control line 19, so that the adjusting pressure in the adjusting pressure line 25 is increased and the adjusting device 7 swivels the hydraulic pump 1 back in the direction of lower displacement volume until the value is below the pre-set maximum power again.

As already stated, an item of hydraulic operating equipment of a construction machine, e.g. the hydraulic actuation device for the excavator shovels of an excavator/loader, may be connected to the delivery line 5*a* while the hydraulic travel drive of the construction machine may be connected to the delivery line 5*b*. As long as the travel drive is not set in operation, i.e. as long as the proportioning throttle 6*b* is closed, the control device according to the invention operates without power restriction as the control inlet X2 is pressureless. Only when the hydraulic travel drive is switched on by opening the proportioning throttle 6*b* is the power control valve 27 activated and monitors the power output to the hydraulic travel drive. If the pre-set maximum power is exceeded the hydraulic pump 1 is swivelled back so as to prevent an overload of the engine, e.g. a diesel engine, driving the hydraulic pump 1 via the shaft 2. By means of the control according to the invention, therefore, an optimum power distribution to the operating equipment connected to the delivery line 5*a* and the travel drive connected to the delivery line 5*b* is achieved. Advantageously the structural outlay for the control device according to the invention is relatively low. The control device known from DE 195 17 974 A1 may be used with slight structural modifications so that a special design for the control task according to the invention is not necessary. This greatly reduces the manufacturing costs.

To limit the flow of the pressure medium through the power control valve 27, a throttle 30 may be provided in the first control line 18*b* of the power-controlled user. Alternatively the throttle may also be arranged in the connecting line 31 leading to the power control valve 27.

Figure 2:
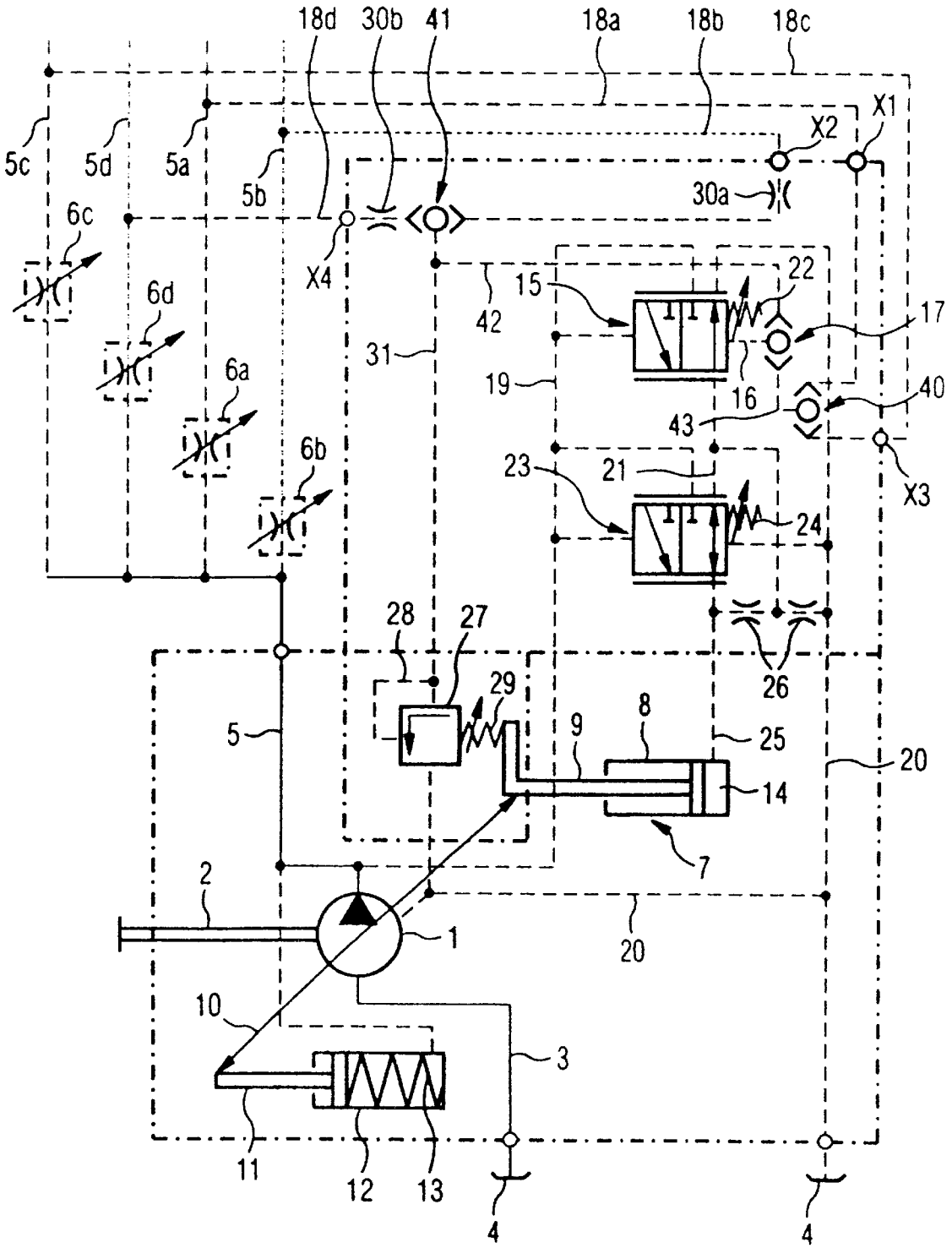
FIG. 2 shows a second embodiment of the control device according to the invention.

FIG. 2 shows a second embodiment of the control device according to the invention. Whereas the control device shown in FIG. 1 and already described is provided for the connection of a power-controlled user and a non-power-controlled user, two power-controlled users and two non-power-controlled users may be connected to the control device shown in FIG. 2. Elements already described are denoted by identical reference numerals so that there is no need for a repeat description to that extent.

In the embodiment shown in FIG. 2 the delivery line 5 branches into a total of four separate delivery lines 5*a* to 5*d*. A separate proportioning throttle 6*a* to 6*d* is allocated to each of the separate delivery lines 5*a* to 5*d* so that the operator can calculate the proportioning of the delivery flow for the users connected to the delivery lines 5*a* to 5*d* individually. A first control line 18*a* to 18*d*, which are fed via control connections X1 to X4 to the control device according to the invention, is allocated to each delivery line 5*a* to 5*d*. Power-controlled users may be connected to the delivery lines 5*b* and 5*d* while non-power-controlled users may be connected to the delivery lines 5*a* and 5*c*. The highest control pressure which prevails in the first control lines 18*a* to 18*d* is selected in a first pressure change device. The first pressure change device consists of the pressure change valve 17 and the two further pressure change valves 40 and 41. The highest control pressure in each case of the two control lines 18*b* and 18*d* which are connected to the delivery lines 5*b* and 5*d* to which power-controlled users are connected is selected with the pressure change valve 41. The control pressure pre-selected in this way is supplied to the pressure change valve 17 via the connecting line 42. The highest control pressure prevailing in the two control lines 18*a* and 18*c* is selected by means of the pressure change valve 40. The control lines 18*a* and 18*c* are connected to delivery lines 5*a* and 5*c* to which non-power-controlled users are connected. The control pressure pre-selected in this way is supplied via a connecting line 43 to the pressure change valve 17 which selects the control pressure which is the highest overall of all first control lines 18*a* to 18*d* and supplies it to the delivery flow control valve 15 via the connecting line 16. The delivery flow control thus takes place on the basis of all control pressures in all first control lines 18*a* to 18*d*.

The pressure change valve 41 serves simultaneously as second pressure change device in order to select the highest control pressure of those first control lines 18*b* and 18*d* which are connected to the delivery lines 5*b* and 5*d* to which power-controlled users are connected. The second pressure change device is thus part of the first pressure change device. The highest control pressure of the first control lines 18*b* and 18*d* is supplied to the power control valve 27 via the connecting line 31 so that the power control only takes place on the basis of those control pressures which originate from delivery lines 5*b* and 5*d* to which power-controlled users are connected.

The control device according to the invention may also be extended in corresponding manner for further power-controlled or non-power-controlled users. For this purpose correspondingly further pressure change valves should be provided in the pressure change devices which are series-connected behind each other in interconnected manner in each case, so that a corresponding number of connections is available for a corresponding number of users.

The power control valve 27 may also be designed in another manner, e.g. as a hyperbolic controller.

What is claimed is:

1. A control device comprising and adjustable hydraulic pump, wherein said hydraulic pump is connected to a plurality of users, by respective delivery lines, each of said delivery lines including an adjustable proportioning throttle, controlled by said control device;

a plurality of first control lines, each connected to a respective one of said delivery lines downstream of said respective proportioning throttle;

a first pressure change device, which selects a highest pressure prevailing in said first control lines and supplies it to a delivery flow control valve; wherein said delivery flow control valve controls an adjusting pressure for an adjusting device to adjust a delivery volume of said hydraulic pump, based on a pressure difference between said highest pressure from said first pressure change device and a pressure from a second control line connected to said delivery lines upstream of said proportioning throttle;

and a power control valve connected between said first control lines of a power-controlled group of users and a pressure medium tank, with pressure from said first control lines of said power-controlled group acting to open said power control valve, and said adjusting device acting, via a measuring spring arrangement, to close said power control valve; and wherein said first control lines of a non-power-controlled group of users are separated from said power control valve.

2. Control device according to claim 1, characterized in that the power control valve (27) is connected to the first control line (18*b*) of a single power-controlled user via a connecting line (31) which opens into the first control line (18*b*) of this power-controlled user upstream of the first pressure change device (17).

3. Control device according to claim 2, characterized in that a throttle is arranged in the connecting line (31) leading to the power control valve (27).

4. Control device according to claim 1, characterized in that the power control valve (27) is connected to the first control lines (18*b*, 18*d*) of a group of several power-controlled users via a connecting line (31), and between a connecting line (31) leading to the power control valve (27) and the first control lines (18*b*, 18*d*) of the power-controlled users, a second pressure change device (41) is provided, which selects the highest of the control pressures prevailing in the first control lines (18*b*, 18*d*) of the group of power-controlled users and conveys it to the connecting line (31).

5. Control device according to claim 4, characterized in that the first and second pressure change device (17, 40, 41; 41) consists of one pressure change valve or several pressure change valves arranged behind each other in interconnected manner.

6. Control device according to claim 5, characterized in that the second pressure change device (41) is part of the first pressure change device (17, 40, 41).

7. Control device according to claim 1, characterized in that a throttle (30; 30*a*, 30*b*) is arranged in each first control line (18*b*, 18*d*) allocated to a power-controlled user.

8. Control device according to claim 1, characterized in that a pressure control valve (23) which is controlled by the control pressure in the second control line (19) is arranged between the delivery flow control valve (15) and the adjusting device (7).

9. Control device according to claim 1, characterized in that the control device serves to control a construction machine, with at least one item of hydraulic operating equipment and a travel drive, the item of operating equipment being a non-power-controlled user and the travel drive being a power-controlled user.

* * * * *